US005511458A

United States Patent [19]

Kamata et al.

[11] Patent Number: 5,511,458

[45] Date of Patent: Apr. 30, 1996

[54] AUTOMATIC CUSHIONING CONTROL APPARATUS FOR CYLINDER OF WORKING MACHINE

[75] Inventors: Seiji Kamata; Kazunori Kuromoto, both of Hiratsuka, Japan

[73] Assignee: Kabushiki Kaisha Komatsu Seisakusho, Tokyo, Japan

[21] Appl. No.: 256,680

[22] PCT Filed: Jan. 20, 1993

[86] PCT No.: PCT/JP93/00070

§ 371 Date: Jul. 20, 1994

§ 102(e) Date: Jul. 20, 1994

[87] PCT Pub. No.: WO93/14321

PCT Pub. Date: Jul. 22, 1993

[30] Foreign Application Priority Data

Jan. 20, 1992 [JP] Japan ..... 4-027536

[51] Int. Cl.[6] ..... F15B 13/16

[52] U.S. Cl. ..... 91/361; 91/397

[58] Field of Search ..... 91/361, 388, 397, 91/403

[56] References Cited

U.S. PATENT DOCUMENTS

| | | | |
|---|---|---|---|
| 4,350,078 | 9/1982 | Olofsson | 91/388 |
| 4,358,989 | 11/1982 | Tordenmalm | 91/361 |
| 4,733,600 | 3/1988 | Masano | 91/461 |
| 4,896,582 | 1/1990 | Tordenmalm et al. | 91/361 |

FOREIGN PATENT DOCUMENTS

| | | |
|---|---|---|
| 61-82006 | 4/1986 | Japan . |
| 61-153003 | 7/1986 | Japan . |
| 2-57703 | 2/1990 | Japan . |
| 2-253002 | 10/1990 | Japan . |
| 3-257229 | 11/1991 | Japan . |

*Primary Examiner*—F. Daniel Lopez

*Attorney, Agent, or Firm*—Richards, Medlock & Andrews

[57] ABSTRACT

An automatic cushioning control apparatus for a cylinder of a working machine provides a quiet cylinder cushioning effect, causing little shaking of a vehicle body, without using a mechanical cylinder cushion. To obtain such an effect, this apparatus is provided with a means (1) for detecting the position of a working machine cylinder in the direction of a stroke thereof, a means (2) for detecting the direction of extending and retracting movement of the cylinder of the working machine, a means (3) for computing lever gain (K) with respect to a lever signal from a lever (4), which is adapted to satisfy the relation, $0<K<1$, in accordance with signals from the means (1,2), and gradually changes from one toward zero in accordance with the distance between the free end of the cylinder and a stroke end thereof when the cylinder is moved toward its stroke end, a multiplication element (5) adapted to multiply an operating instruction from the lever (4) by the lever gain K, and a means (6) for controlling the driving of the cylinder of the working machine in accordance with an output from the multiplication element (5).

20 Claims, 6 Drawing Sheets

$$\begin{cases} K=\frac{1}{Ld}\cdot L\ (0\leqq L<Ld) \\ K=1\ (L\geqq Ld) \end{cases}$$

$$\begin{cases} K=0\ (0\leqq L<Ld) \\ K=\frac{1}{3}\ (Ld\leqq L<2Ld) \\ K=\frac{2}{3}\ (2Ld\leqq L<3Ld) \\ K=1\ (L\geqq 3Ld) \end{cases}$$

$$\begin{cases} K=\frac{1}{2Ld^2}\cdot L^2\ (0\leqq L<Ld) \\ K=1-\frac{1}{2}\cdot e^{-d(L-Ld)}\ (L\geqq Ld) \end{cases}$$

( e : CONSTANT )

AUTOMATIC CUSHIONING CONTROL APPARATUS FOR CYLINDER OF WORKING MACHINE

FIELD OF THE INVENTION

The present invention relates to an automatic cushioning control apparatus for a hydraulic cylinder of a construction equipment working machine such as a hydraulic shovel, wheel loader, and the like.

BACKGROUND ART

Conventionally, construction equipment, which has a working machine such as a hydraulic shovel driven by a hydraulic cylinder, is provided with a mechanical cushion to ease a shock at a stroke end of a cylinder, the shock being caused when an operator operates a lever. If the lever is fully moved, hitting the stroke end, a conventional mechanical cushion cannot completely absorb the inertial force of the working machine, and a big noise is produced at the time of the collision, causing the vehicle body to shake. In addition, a cushion chamber is subjected to a high back pressure, adversely affecting the durability of the cylinder and also leading to higher structural cost. To solve these problems;

(1) there is a method available, wherein a cylinder stroke position is detected so that, when a dangerous zone set near the end of the stroke path is reached, the engine RPM or the angle of a swash plate is decreased to reduce the discharge quantity of a pump, thereby decreasing the speed of the cylinder, and (2) there is another method available, wherein a cylinder control valve is set back to the neutral to stop the cylinder (refer to the Japanese Published Unexamined Patent Application No. 2-57703).

They have, however, disadvantages described below:

(1) The method, wherein the engine RPM or the discharging quantity of the pump is reduced, prevents satisfactory composite operation because an engine pump is not provided on each shaft of the working machine, and therefore, each time one shaft reaches a stroke end, the working speed of other shafts unavoidably decreases. There is another disadvantage in that the engine or the pump is required to exhibit extremely high responsiveness.

(2) The method, wherein the cylinder control valve is set back to the neutral, is disadvantageous in that, when the cylinder length reaches the dangerous zone, a controller issues a signal for setting the valve back to the neutral independently of the lever operation performed by an operator, thus carrying out automatic deceleration irrespectively of operator's intent.

In general, when operating a shaft with high inertia at a full lever stroke, the dangerous zone must be secured with a certain level of ampleness in order to stop the shaft without causing a shock at a stroke end. Such conventional methods, however, make it difficult for the operator to stop the cylinder in a desired position within the dangerous zone, thus narrowing the zone for operating the working machine, wherein the operator can operate it.

SUMMARY OF THE INVENTION

The present invention has been achieved to solve the problems with the conventional methods, and it is an object of the present invention to provide an automatic cushioning control apparatus for a cylinder of a working machine, which is capable of providing cushioning effect for minimizing noises and shaking of a vehicle body by ensuring adequate deceleration at the time of cushioning to avoid generating high pressure, without using a mechanical cylinder cushion, and which also contributes to high durability of the cylinder main body.

In construction equipment having a working machine driven by a working machine hydraulic cylinder, the present invention has a cylinder position detecting means for detecting the position of a working machine cylinder along the stroke path thereof in the direction of a stroke thereof, a moving direction detecting means for detecting the direction of extending and retracting movement of the working machine cylinder along the stroke path, a lever gain computing means for computing lever gain K with respect to a lever signal from a lever device, which is adapted to satisfy a relationship, $0<K<1$, in accordance with signals from the aforesaid cylinder position detecting means and the moving direction detecting means, and which gradually changes from one toward zero in accordance with the distance to a stroke end when the cylinder is moving toward the stroke end, a multiplication element for multiplying an operating instruction from the lever device by the lever gain, and a cylinder control means for controlling the drive of the cylinder of the working machine in accordance with an output signal from the multiplication element.

Further, in construction equipment having a working machine driven by a working machine cylinder, the present invention has a cylinder position detecting means for detecting the position of the working machine cylinder in the direction of the stroke thereof, a moving direction detecting means for detecting the direction of extending and retracting movement of the cylinder of the working machine, a cylinder control amount computing means, which receives the signals from the cylinder position detecting means and the moving direction detecting means and a lever signal from the lever device and outputs a value determined from a cylinder control amount computation table, which is determined by the distance to a stroke end, the cylinder moving direction, and the magnitude of the lever signal, and a cylinder control means, which receives the output signal from the cylinder control amount computing means to drive the cylinder of the working machine.

Furthermore, the present invention is provided with a relay for rendering the output signal of the multiplication element or the output signal of the cylinder control amount computing means and the lever signal from the lever device selectable with respect to the cylinder control means, and a selector switch for controlling the relay.

In such a configuration, a cylinder position signal s from the cylinder position detecting means and a direction signal d from the moving direction detecting means are applied to the lever gain computing means to compute a distance L to a stroke end. According as whether the direction signal d is positive or negative, a value of function $K=f(d, L)$ is computed and outputted, the form of the function being given in advance and which is determined by the direction causing the value to change from one toward zero as the distance L decreases when the cylinder is moved toward a stroke end and by the distance L. The result is multiplied by the multiplication element as a lever gain K with respect to a lever signal q from the lever device and an output, $K \cdot q$, is applied to the cylinder control means to perform the cushioning control at the stroke end of the cylinder of the working machine.

Thus, the lever signal q is narrowed in accordance with the distance L to the stroke end; when the moving speed of the cylinder of the working machine is slow, the stroke end distance L decreases slowly, accordingly causing the lever gain K to decrease toward zero slowly. Likewise, when the cylinder speed is fast, the distance L to the stroke end also changes quickly, causing the lever gain K to decrease quickly toward zero, thereby making it possible to promptly effect the cylinder cushioning in accordance with the then speed.

On the other hand, when the operating lever is moved away from the stroke end, the distance L to the stroke end increases and the lever gain K becomes 1, permitting normal operation.

Thus, the operator can easily position the working machine in a desired position within the movable range of the working machine without worrying about the shock at the stroke end.

In addition, when the operator intentionally hits the stroke end to remove earth from the working machine such as a hydraulic shovel, the cushioning function can be easily rendered ineffective by a switch to allow the removal of the earth from the working machine.

BEST MODE FOR CARRYING OUT THE INVENTION

The first embodiment of the present invention will be described with connection to the attached drawings.

Figure 1:
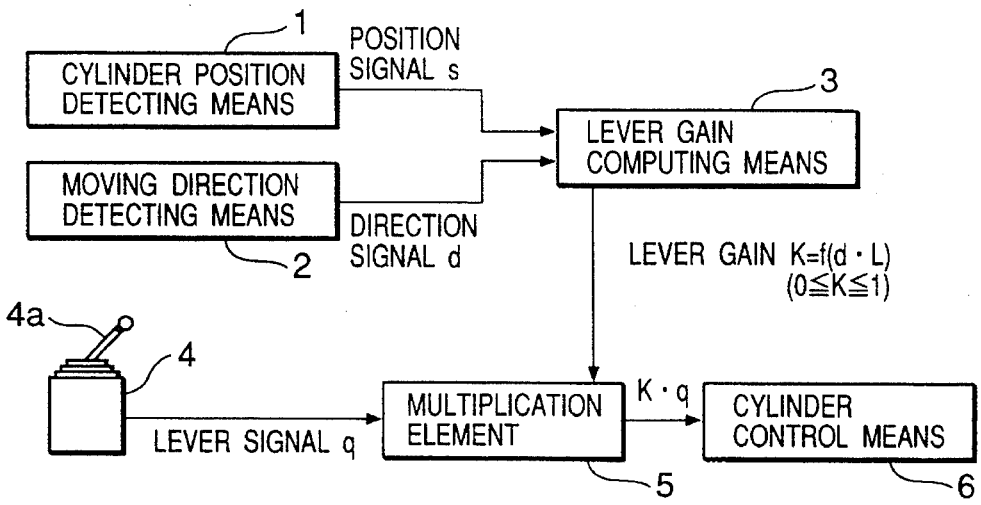
FIG. 1 is a configuration diagram showing a first embodiment of the present invention.

In FIG. 1, numeral 1 denotes the cylinder position detecting means, which detects the position of the cylinder of the working machine in the direction of stroke and outputs the position signal s; numeral 2 denotes the moving direction detecting means, which detects the direction of extending or retracting movement of the cylinder of the working machine and outputs the direction signal d; numeral 3 denotes the lever gain computing means, which computes, based on the two signals, s and d, the lever gain K with respect to the direction signal d, the gain taking a value lying in a range of 0 to 1 and gradually approaching 0 from 1 in accordance with the distance L to the stroke end when the cylinder is moving toward the stroke end and which outputs the result; numeral 4 indicates the lever device for the working machine, which outputs the lever signal q, which is an operating instruction corresponding to the rotational angle of an operating lever 4*a*; numeral 5 denotes the multiplication element, which multiplies the lever signal q by the aforesaid lever gain K and outputs the cylinder control signal K·q; and numeral 6 denotes the cylinder control means, which drives the cylinder of the working machine in accordance with the cylinder control signal K·q.

In such a configuration, the cylinder position signal s from the cylinder position detecting means 1 and the direction signal d from the moving direction detecting means 2 are applied to the lever gain computing means 3 to compute the distance L to the stroke end. The value of the function $K=f(d \cdot L)$ is computed and outputted, the form of the function being given in advance and determined by the direction signal, which changes from zero to one when the cylinder is moved in the direction away from the stroke end, while it changes from one toward zero when the cylinder is moved in the direction toward the stroke end according as whether the direction signal d is positive or negative, and by the distance L. The result is inputted to the multiplication element 5 as a lever gain K and is multiplied therein by the lever signal q from the lever device 4, and the output signal, K·q, is applied to the cylinder control means 6 to perform the cushioning control at the stroke end of the cylinder of the working machine.

Thus, the lever signal q is narrowed in accordance with the distance L to the stroke end; when the moving speed of the cylinder of the working machine is slow, the stroke end distance L decreases slowly, accordingly causing the lever gain K to decrease toward zero slowly. Likewise, when the cylinder speed is fast, the distance L to the stroke end also changes quickly, causing the lever gain K to decrease quickly toward zero. Thus, the cushioning of the cylinder of the working machine can be efficiently effected in accordance with the speed.

On the other hand, when an operating lever 4*a* of the lever device 4 is moved away from the stroke end, the distance L to the stroke end increases and the lever gain K becomes 1, permitting normal operation.

Hence, the operator can easily position the working machine in a desired position within the movable range of the working machine without worrying about the shock at the stroke end.

The cylinder position detecting means 1 can be a means whereby the stroke length of the cylinder of the working machine is directly detected by a directly driven sensor, e.g., a linear potentiometer or a magnetic or optical linear encoder, or it can be a publicly known means whereby the stroke length is detected as the distance to a stroke end by using ultrasonic distance sensors or laser distance sensors mounted on the stroke end sections on both ends or on a rod. In general, the cylinder stroke length corresponds to the rotational angle of the working machine in a one-to-one relationship; therefore, once the rotational angle is detected, the position of the cylinder can be determined by geometrical calculation. In this case, there is also another method available, wherein the posture of the working machine is detected using a rotational angle sensor such as a rotary potentiometer and a rotary encoder to determine the position of the cylinder. There is still another method, wherein a clinometer is used to detect the posture angle of the working machine.

For the moving direction detecting means 2, there is a method available, wherein the speed component is determined, taking the position signal s from the cylinder position detecting means 1 as a differential or difference and the result provides the direction signal d. There is another method available, wherein the lever signal q from the lever device 4 is taken as the direction signal d. There is still another method available, wherein the forward movement and the reverse movement are detected from the order of the changes of A-phase pulse and the B-phase pulse in the encoder.

Figure 2:
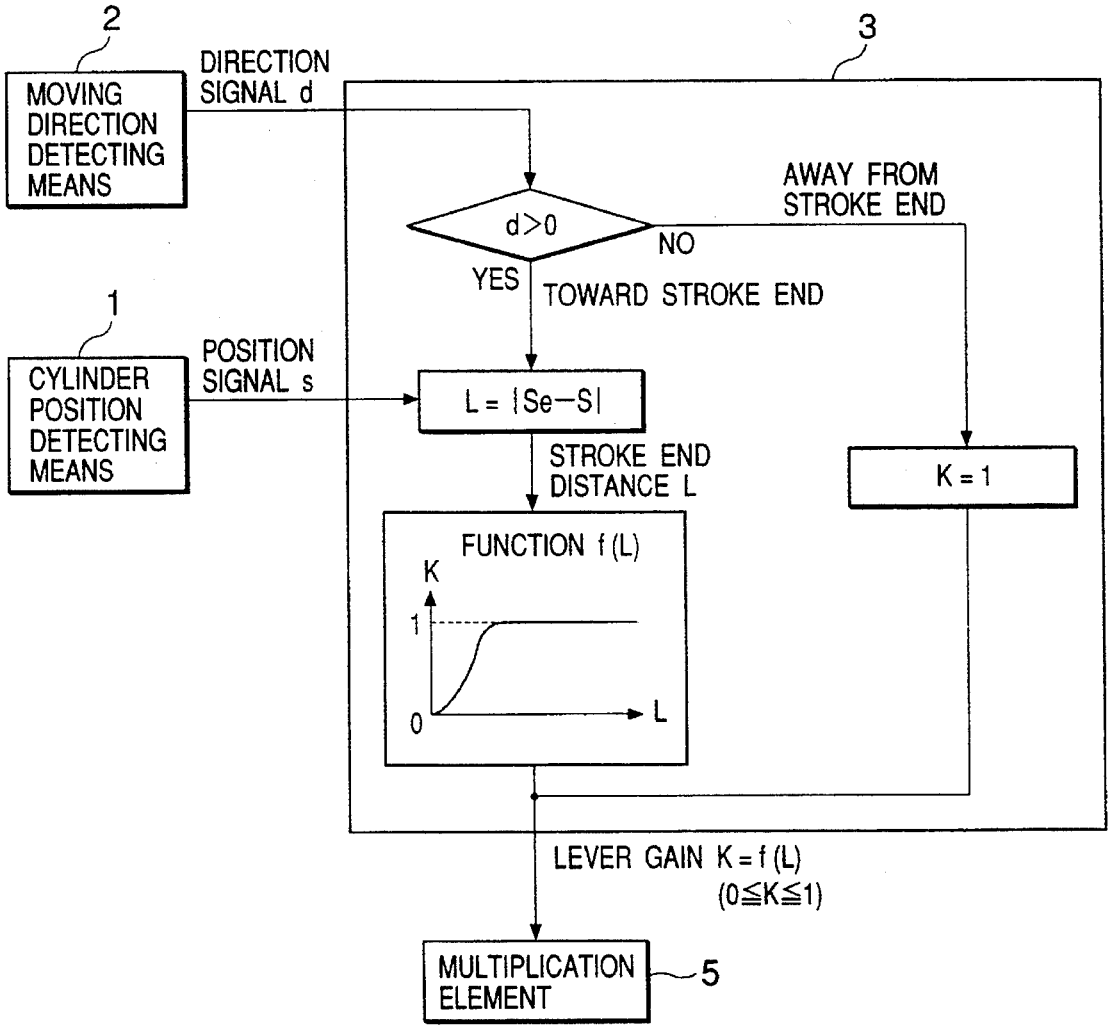
FIG. 2 is a block diagram showing an example of a lever gain computing means of the first embodiment.

The lever gain computing means 3 receives the position signal s from the cylinder position detecting means 1 and the direction signal d from the moving direction detecting means 2; and as shown in FIG. 2, according to whether the direction signal d is positive or negative, the lever gain is set as K=1 if the cylinder is moving away from the stroke end, while if the cylinder is moving toward the stroke end, then the absolute value of the difference between a stroke end position Se given beforehand and a detection position S is determined as the distance L to the stroke end. The lever gain K=f(L) corresponding to the then L may be determined according to the gain function f(L), which is determined by the distance L to the stroke end and the form of which is given in advance, the result being sent to the multiplication element 5.

Figure 3:
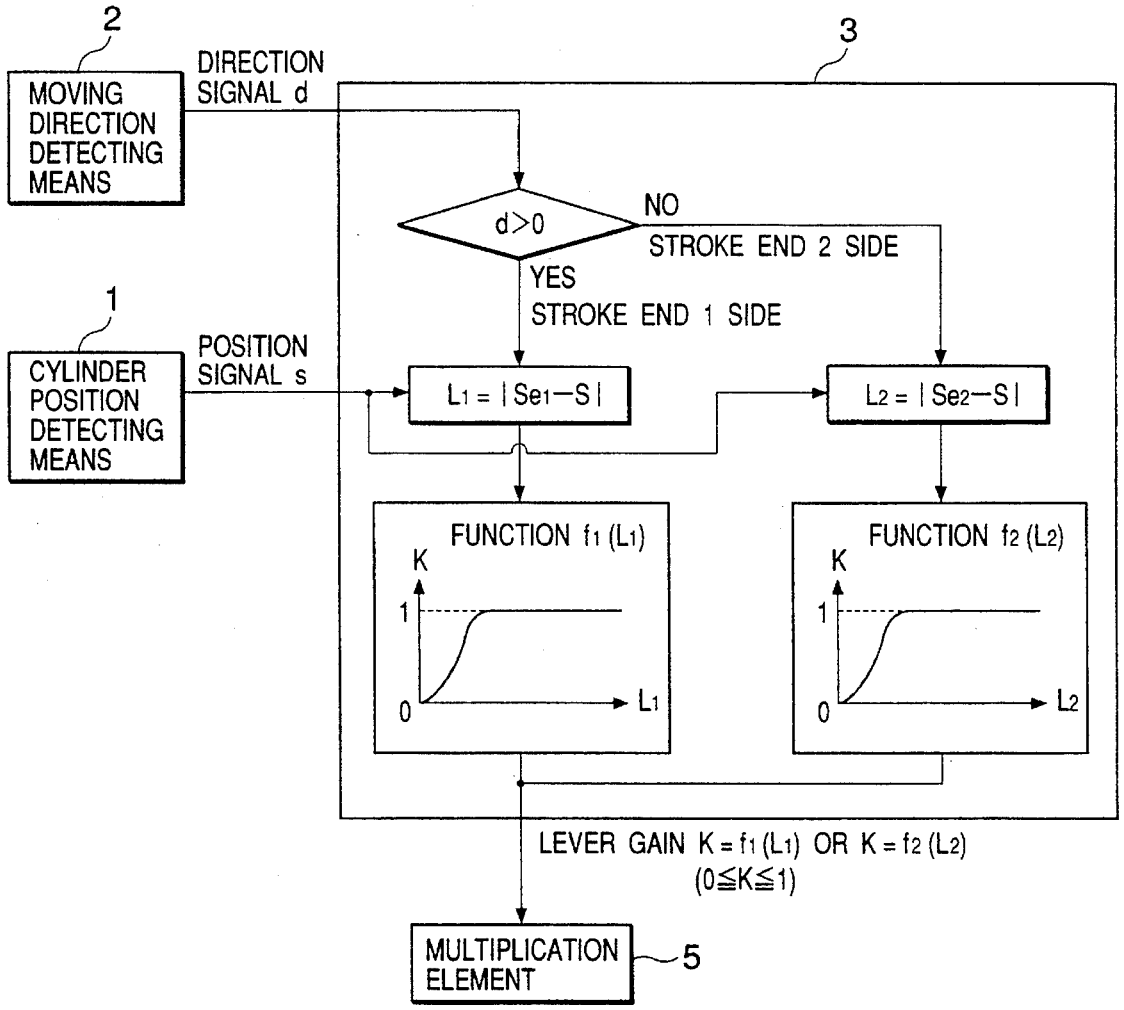
FIG. 3 is a block diagram showing another example of the lever gain computing means of the first embodiment.

In addition, in order to provide the stroke ends of both ends of the cylinder with cushioning, the moving direction is determined according as whether the direction signal d is positive or negative and the absolute values of the differences between a stroke end position $Se_1$, on the first side in the approaching direction or a stroke end position $Se_2$ on the second side and the position of detection S are determined as distances $L_1$ and $L_2$ to the stroke ends as shown in FIG. 3. The gain function, which is determined by the distances $L_1$ and $L_2$ to the stroke ends and which is given in advance, can be set as $f_1(L_1)=f_2(L_2)$ or different gain functions can be given as $f_1(L_1)\neq f_2(L_2)$. The lever gain K is determined using the gain function $f_1(L_1)$ or $f_2(L_2)$, and the result is outputted to the multiplication element 5.

Figure 4A:
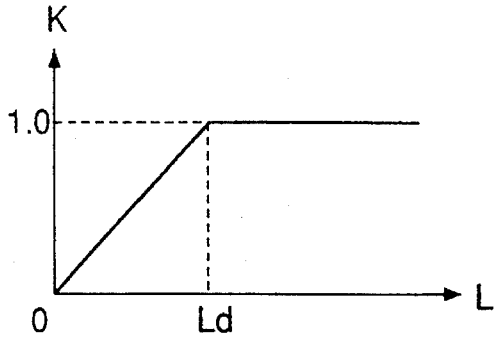
FIG. 4A, FIG. 4B, and FIG. 4C are charts showing different gain coefficients in the lever gain computing means.
Figure 4B:
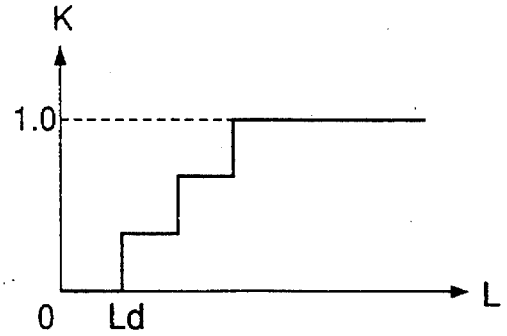
Figure 4C:
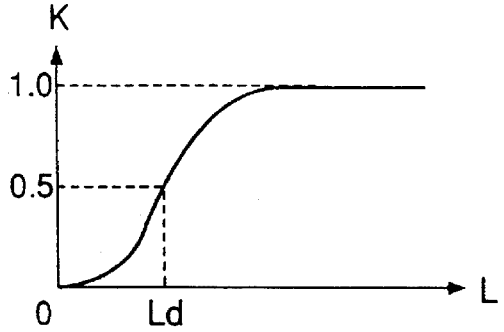

For a distance Ld given in advance, the gain function f(L) can be given as a function, which decreases in proportion to the distance L to the stroke end in a deceleration area as shown in FIG. 4A. Alternatively, for the distance Ld given in advance, the function can be given as a function, which decreases in steps in the deceleration area as shown in FIG. 4B. Further alternatively, for the distance Ld given in advance, the function can be given as a function, which combines the quadratic curve and the exponential curve of L in the deceleration area as shown in FIG. 4C.

Furthermore, instead of the distance L to the stroke end, the rotational angle of the working machine can be used for calculating from a deviation angle up to a movable limit angle.

As the lever device 4, an electrical lever, wherein an output is taken out in the form of a voltage corresponding to a lever operating amount can be used, or a proportional control lever (hereinafter referred to as PPC), wherein the output is taken out in the form of hydraulic pressure corresponding to the lever operating amount, can be used.

Figure 5:
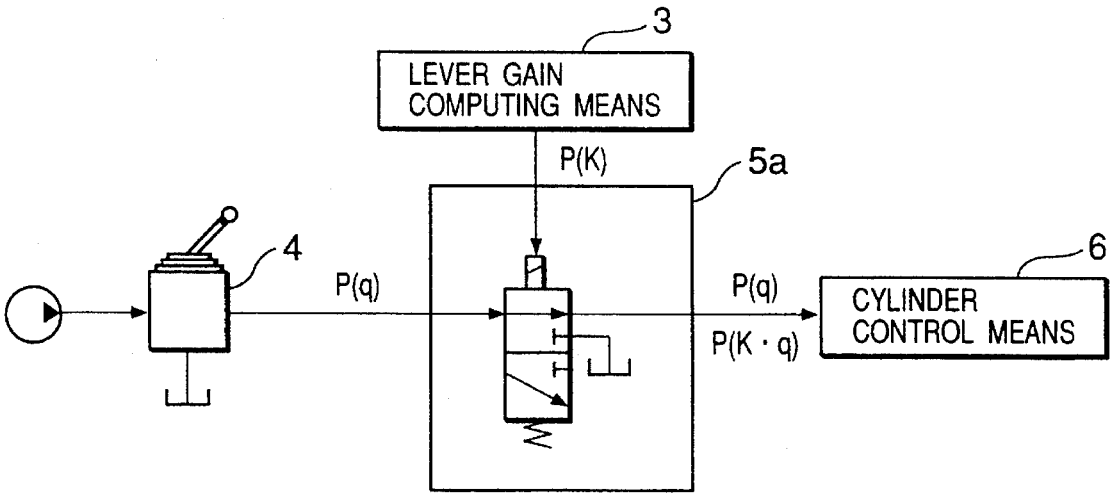
FIG. 5 is a circuit diagram, wherein a proportional control valve is employed as the multiplication element of the first embodiment.

The multiplication element 5 electrically performs multiplication by the lever gain K through an analog circuit or microcomputer when the lever device 4 is an electrical lever. If the PPC lever is used, then PPC pressure P(q) from the lever device 4 is reduced via an electromagnetic proportional valve 5*a*, which is driven by a signal P(K) outputted from the lever gain computing means 3, as shown in FIG. 5. This causes the PPC pressure P(q) to be passed as it is when the lever gain K is 1, while the PPC pressure P(q) is cut and a pressure P(K·q) is outputted when the lever gain K is less than 1.

A cylinder control means 6 is a regular valve for driving a hydraulic cylinder and it controls the amount of oil flowing into and out of the cylinder of the working machine or the speed by controlling the area of the opening electrically or hydraulically.

The second embodiment of the present invention will now be described with reference to FIG. 6 and FIG. 7. The same constituents as those of the first embodiment will be given the same numerals and the explanation thereof will be omitted.

Figure 6:
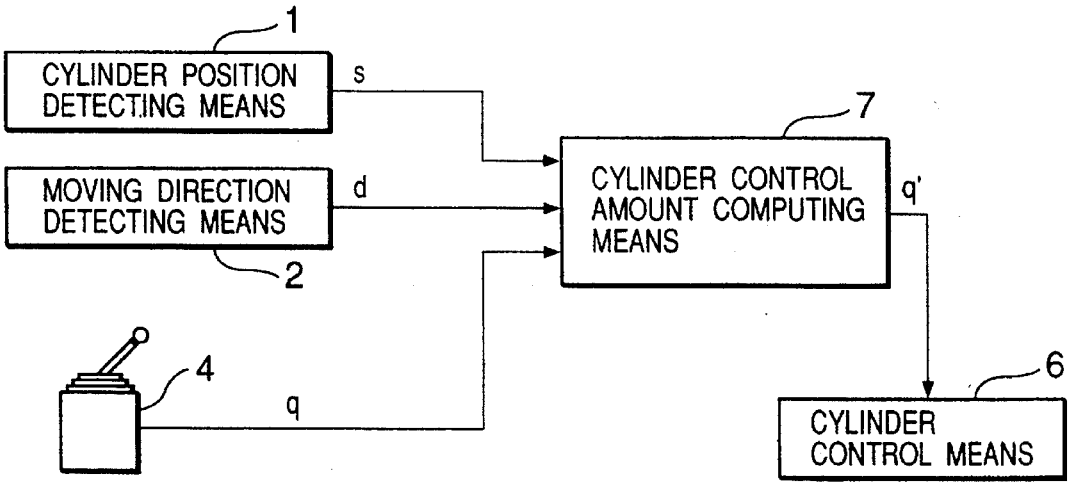
FIG. 6 is a configuration diagram showing a second embodiment of the present invention.

A cylinder control amount computing means 7 stores the computation table of a cylinder control amount q', which is determined by three signals, namely, the lever signal q from the lever device 4, the position signal s from the cylinder position detecting means 1, and the direction signal d from the moving direction detecting means 2 as shown in FIG. 6. The cylinder control amount q' thus computed is applied as a signal to the cylinder control means 6. The multiplication element 5, which multiplies the lever signal q by the gain K in the first embodiment is omitted.

Figure 7:
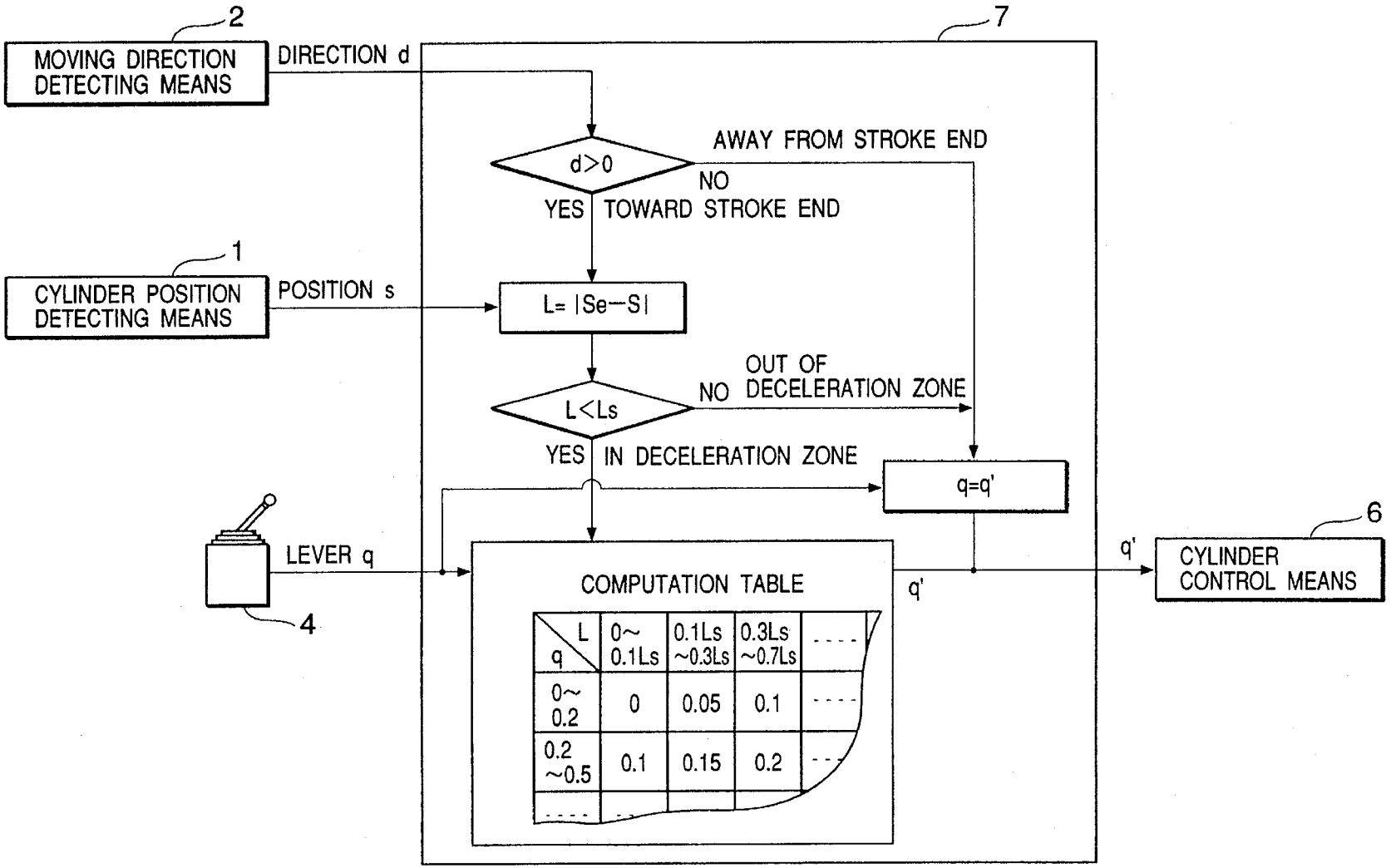
FIG. 7 is a block diagram showing a cylinder control amount computing means of the second embodiment.

The details of the cylinder control amount computing means 7 are shown in FIG. 7. If the movement of the cylinder of the working machine is in the direction away from the stroke end or if the distance L to a stroke end is out of a deceleration area Ls given in advance, then the lever signal q is supplied unchanged as the cylinder control amount q' to the cylinder control means 6. On the other hand, if the movement of the cylinder of the working machine is in the direction toward the stroke end and the distance L to the stroke end is within the deceleration area Ls given in advance, then the cylinder control amount q' is determined in accordance with the "computation table" which is determined by the lever signal q and the distance L to the stroke end and which is given beforehand, and the result is outputted in the form of a signal to the cylinder control means 6. This enables the cushioning function to work at the stroke end.

Figure 8:
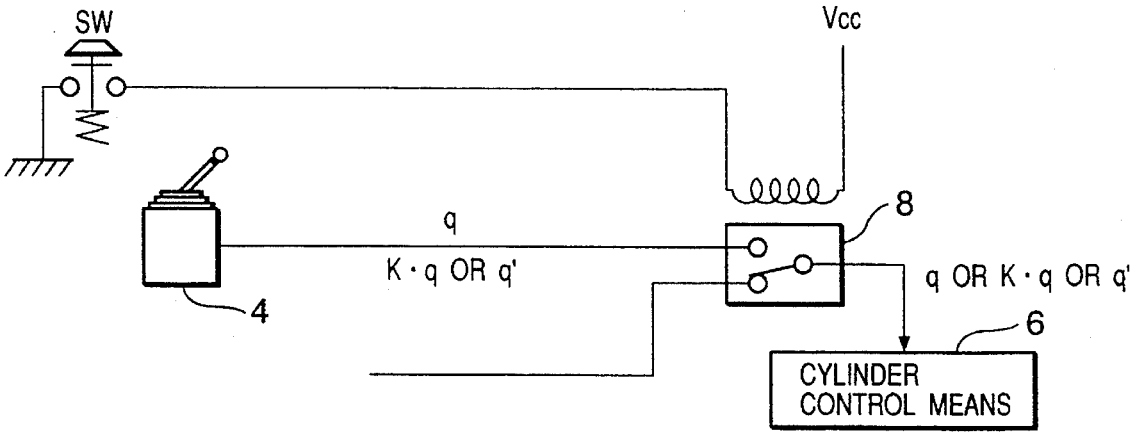
FIG. 8 is a circuit diagram, wherein the cylinder control is made selectable.

FIG. 8 shows a circuit consisting of the circuit of the first or second embodiment, to which a relay 8 and a switch SW are added to make the cushioning function selectable. When the switch SW is turned ON, the relay 8 is connected to a circuit on the lever signal q side and the lever signal q is supplied to the cylinder control means 6. On the other hand, if the switch SW is turned OFF, then the relay 8 is connected to a circuit on the output signal K·q side of the multiplication element 5 and the output signal K·q is outputted to the cylinder control means 6 in the case of the first embodiment. In the case of the second embodiment, the relay 8 is connected to a circuit on the side of the cylinder control amount q', which is outputted from the cylinder control amount computing means 7, and the cylinder control amount q' is applied as a signal to the cylinder control means 6.

INDUSTRIAL APPLICABILITY

The present invention is useful as an automatic cushioning control apparatus, which is capable of providing cushioning effect for minimizing noises and shaking of a vehicle body by ensuring adequate deceleration at the time of cushioning to avoid generating high pressure, without using a mechanical cylinder cushion, and also contributes to high durability of the cylinder main body in a working machine, such as a hydraulic shovel and a wheel loader of construction equipment, which is driven by a hydraulic cylinder.

What is claimed is:

1. An automatic cushioning control apparatus for a hydraulic cylinder, wherein said hydraulic cylinder is capable of extending movement and retracting movement as strokes in stroke directions along a stroke path in response to a lever signal from a lever device, the stroke path having a full stroke length and a stroke end, said automatic cushioning control apparatus comprising:

said lever device for establishing said lever signal, a cylinder position detecting means for detecting a position of the hydraulic cylinder along the stroke path in a direction of a movement of the hydraulic cylinder as a stroke of the hydraulic cylinder and establishing a position signal representative thereof, a moving direction detecting means for detecting the direction of a movement of the hydraulic cylinder as a stroke along the stroke path and establishing a direction signal representative thereof, a cylinder control amount computing means which receives the position signal, the direction signal, and the lever signal, and outputs a cylinder control signal which is determined by a distance from the thus detected position to the stroke end, the direction of the movement of the hydraulic cylinder, and the magnitude of the lever signal, and a cylinder control means which receives the cylinder control signal and controls the movement of the hydraulic cylinder along the stroke path in accordance with the cylinder control signal.

2. Apparatus in accordance with claim 1, further comprising a relay for selectively applying to said cylinder control means one of the cylinder control signal from said cylinder control amount computing means and the lever signal from said lever device, and a selector switch for controlling the relay.

3. Apparatus in accordance with claim 1, wherein said cylinder control amount computing means comprises:

means responsive to said direction signal for determining whether the direction of the stroke is toward or away from the stroke end, means responsive to said position signal for determining the distance between the thus detected position of the hydraulic cylinder and the stroke end when the direction of the stroke is toward the stroke end, means responsive to the thus determined distance for determining whether the position of the hydraulic cylinder is within a deceleration zone when the direction of the stroke is toward the stroke end, means responsive to a determination that the position of the hydraulic cylinder is within the deceleration zone for establishing a first cylinder control signal and for outputting the first cylinder control signal to the cylinder control means, and means for outputting to the cylinder control means a second cylinder control signal representative of said lever signal when the thus determined direction of the stroke is away from the stroke end and when the thus determined direction of the stroke is toward the stroke end and the position of the hydraulic cylinder is outside of the deceleration zone.

4. Apparatus in accordance with claim 3, wherein the means for establishing the first cylinder control signal includes a computation table.

5. An automatic cushioning control apparatus for a hydraulic cylinder, wherein said hydraulic cylinder is capable of extending movement and retracting movement as strokes in stroke directions along a stroke path in response to a lever signal from a lever device, the stroke path having a full stroke length and a stroke end, said automatic cushioning control apparatus comprising:

said lever device for establishing said lever signal, a cylinder position detecting means for detecting a position of the hydraulic cylinder along the stroke path in a direction of a movement of the hydraulic cylinder as a stroke of the hydraulic cylinder along the stroke path and establishing a position signal representative thereof, a moving direction detecting means for detecting a direction of a movement of the hydraulic cylinder as a stroke along the stroke path and establishing a direction signal representative thereof, a lever gain computing means for computing a lever gain K in accordance with said position signal and said direction signal and outputting a lever gain signal representative thereof, the thus computed lever gain satisfying a relationship $0<K<1$ and gradually changing from one toward zero in accordance with a distance from the hydraulic cylinder to said stroke end when the hydraulic cylinder is moving toward said stroke end, a multiplication element for multiplying the lever signal from the lever device by said lever gain signal and establishing an output signal representative of the multiplication product, and a cylinder control means for controlling the movement of the hydraulic cylinder along the stroke path in accordance with the output signal from the multiplication element.

6. Apparatus in accordance with claim 5, further comprising a relay for selectively applying to said cylinder control means one of the output signal from said multiplication element and the lever signal from said lever device, and a selector switch for controlling the relay.

7. Apparatus in accordance with claim 5, wherein said lever device comprises a proportional control lever and outputs a hydraulic pressure corresponding to an operating amount of the proportional control lever, and wherein said multiplication element comprises an electromagnetic proportional valve which receives the hydraulic pressure from the lever device and is driven by a lever gain signal outputted from the lever gain computing means.

8. Apparatus in accordance with claim 5, wherein said lever gain computing means comprises means responsive to said direction signal for determining whether the direction of the stroke is toward or away from the stroke end, and wherein said lever gain computing means provides a lever gain of one when the hydraulic cylinder is moving away from said stroke end.

9. Apparatus in accordance with claim 5, wherein said lever gain computing means comprises means responsive to said direction signal for determining whether the direction of the stroke is toward or away from the stroke end, means responsive to said position signal for determining the distance between the thus detected position of the hydraulic cylinder and the stroke end when the direction of the stroke is toward the stroke end, means responsive to the thus determined distance for outputting a lever gain signal satisfying the relationship $0<K<1$ with K gradually changing from one toward zero in accordance with the distance to said stroke end when the hydraulic cylinder is moving toward said stroke end, and means for outputting a lever gain signal representative of one when the direction of the stroke is away from the stroke end.

10. Apparatus in accordance with claim 5, wherein said stroke path has first and second stroke ends, and wherein said lever gain computing means comprises:

means responsive to said direction signal for determining whether the direction of the stroke is toward the first stroke end or toward the second stroke end, means responsive to said position signal for determining the distance between the thus detected position of the hydraulic cylinder and the first stroke end when the direction of the stroke is toward the first stroke end, means responsive to the thus determined distance between the thus detected position of the hydraulic cylinder and the first stroke end for outputting a lever gain signal K satisfying the relationship 0<K<1 and gradually changing from one toward zero in accordance with the distance to the first stroke end when the hydraulic cylinder is moving toward the first stroke end, means responsive to said position signal for determining the distance between the thus detected position of the hydraulic cylinder and the second stroke end when the direction of the stroke is toward the second stroke end, and means responsive to the thus determined distance between the thus detected position of the hydraulic cylinder and the second stroke end for outputting a lever gain signal K satisfying the relationship 0<K<1 and gradually changing from one toward zero in accordance with the distance to the second stroke end when the hydraulic cylinder is moving toward the second stroke end.

11. Apparatus in accordance with claim 10, further comprising a relay for selectively applying to said cylinder control means one of the output signal from said multiplication element and the lever signal from said lever device, and a selector switch for controlling the relay.

12. Apparatus in accordance with claim 10, wherein said lever device comprises a proportional control lever and outputs a hydraulic pressure corresponding to an operating amount of the proportional control lever, and wherein said multiplication element comprises an electromagnetic proportional valve which receives the hydraulic pressure from the lever device and is driven by a lever gain signal outputted from the lever gain computing means.

13. A method for automatic cushioning of a hydraulic cylinder, wherein said hydraulic cylinder is capable of extending movement and retracting movement along a stroke path in response to a lever signal from a lever device, the stroke path having a full stroke length and a stroke end, said method comprising the steps of:

establishing a lever signal, detecting a position of the hydraulic cylinder along the stroke path in a direction of a stroke of the hydraulic cylinder and establishing a position signal representative thereof, detecting the direction of a movement of the hydraulic cylinder along the stroke path and establishing a direction signal representative thereof, computing a lever gain K in accordance with said position signal and said direction signal and outputting a lever gain signal representative thereof, the thus computed lever gain satisfying a relationship 0<K<1and gradually changing from one toward zero in accordance with a distance from the hydraulic cylinder to said stroke end when the hydraulic cylinder is moving toward said stroke end, multiplying the lever signal by said lever gain signal and establishing an output signal representative of the multiplication product, and controlling the movement of the hydraulic cylinder along the stroke path in accordance with the output signal representative of the multiplication product.

14. A method in accordance with claim 13, wherein the step of controlling the movement of the hydraulic cylinder along the stroke path in accordance with the output signal representative of the multiplication product comprises selectively controlling the movement of the hydraulic cylinder along the stroke path in accordance with one of the lever signal and the output signal representative of the multiplication product.

15. A method in accordance with claim 13, further comprising determining whether the direction of the stroke is toward or away from the stroke end, and causing said thus computed lever gain to be equal to one when the hydraulic cylinder is moving away from said stroke end.

16. A method in accordance with claim 13, wherein the step of computing a lever gain comprises:

determining responsive to said direction signal whether the direction of the stroke is toward or away from the stroke end, determining responsive to said position signal the distance between the thus detected position of the hydraulic cylinder and the stroke end when the direction of the stroke is toward the stroke end, establishing responsive to the thus determined distance a lever gain signal K satisfying the relationship 0<K<1 and gradually changing from one toward zero in accordance with the distance to said stroke end when the hydraulic cylinder is moving toward said stroke end, and establishing a lever gain signal of one when the direction of the stroke is away from the stroke end.

17. A method in accordance with claim 13, wherein the stroke path has a first stroke end and a second stroke end, and wherein the step of computing a lever gain comprises the steps of:

determining responsive to said direction signal whether the direction of the stroke is toward the first stroke end or toward the second stroke end, determining responsive to said position signal the distance between the thus detected position of the hydraulic cylinder and the first stroke end when the direction of the stroke is toward the first stroke end, establishing responsive to the thus determined distance between the thus detected position of the hydraulic cylinder and the first stroke end a lever gain signal K satisfying the relationship 0<K<1 and gradually changing from one toward zero in accordance with the distance to the first stroke end when the hydraulic cylinder is moving toward the first stroke end, determining responsive to said position signal the distance between the thus detected position of the hydraulic cylinder and the second stroke end when the direction of the stroke is toward the second stroke end, and establishing responsive to the thus determined distance between the thus detected position of the hydraulic cylinder and the second stroke end a lever gain signal K' satisfying the relationship 0<K<1 and gradually changing from one toward zero in accordance with the distance to the second stroke end when the hydraulic cylinder is moving toward the second stroke end.

18. A method in accordance with claim 13, wherein the step of computing a lever gain K in accordance with said position signal and said direction signal comprises determining the distance between the thus detected position of the hydraulic cylinder and the stroke end, outputting a lever gain signal which is proportional to the thus determined distance when the thus determined distance is less than a predetermined distance, and outputting a lever gain signal which is representative of one when the thus determined distance is at least as large as the predetermined distance.

19. A method in accordance with claim 13, wherein the step of computing a lever gain K in accordance with said position signal and said direction signal comprises determining the distance between the thus detected position of the hydraulic cylinder and the stroke end, outputting a lever gain signal which decreases in steps from one to zero when the thus determined distance is progressively reduced below a predetermined distance, and outputting a lever gain signal which is representative of one when the thus determined distance is at least as large as the predetermined distance.

20. A method in accordance with claim 13, wherein the step of computing a lever gain K in accordance with said position signal and said direction signal comprises determining the distance between the thus detected position of the hydraulic cylinder and the stroke end, outputting a lever gain signal which is an exponential function of the thus determined distance when the thus determined distance is less than a predetermined distance, and outputting a lever gain signal which is a quadratic function of the thus determined distance when the thus determined distance is greater than said predetermined distance.

* * * * *

UNITED STATES PATENT AND TRADEMARK OFFICE

CERTIFICATE OF CORRECTION

PATENT NO. : 5,511,458

DATED : April 30, 1996

INVENTOR(S) : Seiji KAMADA et al

It is certified that error appears in the above-indentified patent and that said Letters Patent is hereby corrected as shown below:

Title page, item [75] & [19], delete "Kamata" and insert --Kamada--.

Signed and Sealed this

Third Day of December, 1996

*Attest:*

*Attesting Officer*

BRUCE LEHMAN

*Commissioner of Patents and Trademarks*